US009062424B2

(12) United States Patent
Buhagiar

(10) Patent No.: US 9,062,424 B2
(45) **Date of Patent: *Jun. 23, 2015**

(54) ANIMAL WASTE DISPOSAL TOOL

(71) Applicant: Jordan A Buhagiar, West Sacramento, CA (US)

(72) Inventor: Jordan A Buhagiar, West Sacramento, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/908,771

(22) Filed: Jun. 3, 2013

(65) Prior Publication Data

US 2013/0270846 A1 Oct. 17, 2013

Related U.S. Application Data

(63) Continuation-in-part of application No. 13/068,854, filed on May 11, 2010, now Pat. No. 8,474,890, and a continuation-in-part of application No. 12/136,309, filed on Jun. 10, 2008, now Pat. No. 8,132,834.

(60) Provisional application No. 61/726,153, filed on Nov. 14, 2012.

(51) Int. Cl.

| | |
|---|---|
| ***A01K 29/00*** | (2006.01) |
| ***E01H 1/00*** | (2006.01) |
| *E01H 1/12* | (2006.01) |

(52) U.S. Cl.

CPC ..... *E01H 1/006* (2013.01); *E01H 2001/1293* (2013.01); *E01H 1/1206* (2013.01)

(58) Field of Classification Search

CPC ..... A47L 13/52; A47L 7/04; A47L 25/005; A47L 13/502; E01H 1/1206; E01H 2001/1293; E01H 1/12; A01K 1/0107; A01K 1/0114; A01K 1/011; A01K 23/005; A01B 1/18

USPC ..... 294/1.2, 1.3, 1.4, 1.5, 209, 50.5, 50.9, 294/61; 15/257.1, 257.2, 257.3, 257.01, 15/104.001; 119/161, 867

See application file for complete search history.

(56) References Cited

U.S. PATENT DOCUMENTS

| | | | | |
|---|---|---|---|---|
| 3,879,079 | A * | 4/1975 | Nicholas | 294/1.4 |
| D285,012 | S * | 8/1986 | Willis | D30/162 |
| 4,641,873 | A * | 2/1987 | Nurnberger | 294/1.4 |
| 6,019,405 | A * | 2/2000 | Tsou | 294/1.4 |
| 6,478,351 | B1 * | 11/2002 | Nelson | 294/1.4 |
| 6,796,587 | B2 * | 9/2004 | Tsou | 294/1.4 |

* cited by examiner

*Primary Examiner* — Stephen Vu

(74) *Attorney, Agent, or Firm* — Edward S. Sherman

(57) ABSTRACT

A tool for retrieving animal waste is effective in complete removal as it deploys at its end a row of tines that are inserted beneath the solid waste so that is can be lifted from the ground as the first step for proper disposal. The waste is then removed from the tines by a plate that pushes it off into a waste receptacle.

20 Claims, 15 Drawing Sheets

FIG. 1A
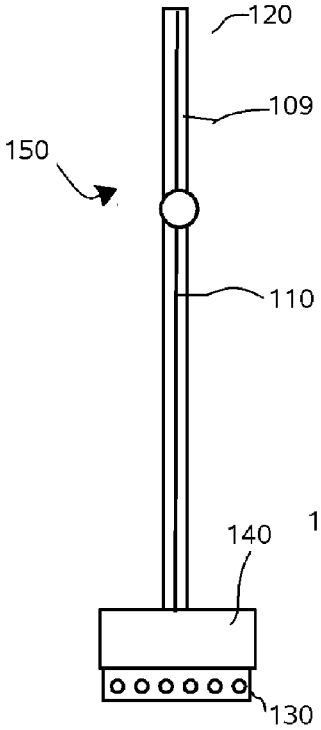
FIG. 1B
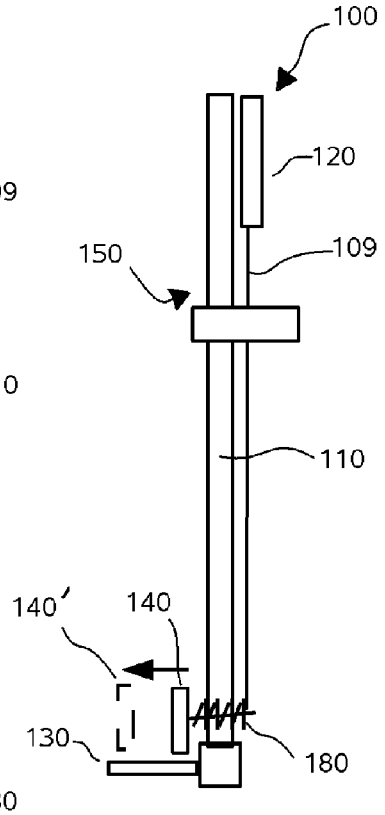
FIG. 1C
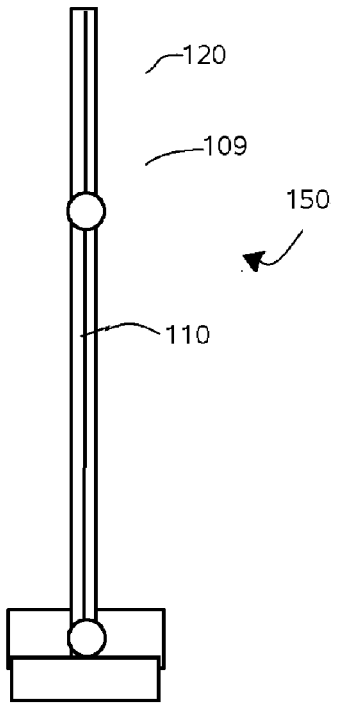
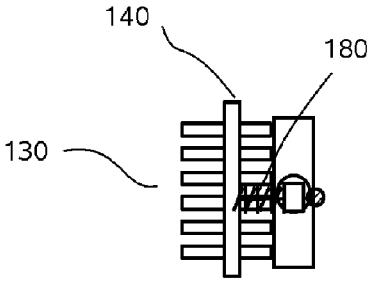
FIG. 1D

FIG. 2A
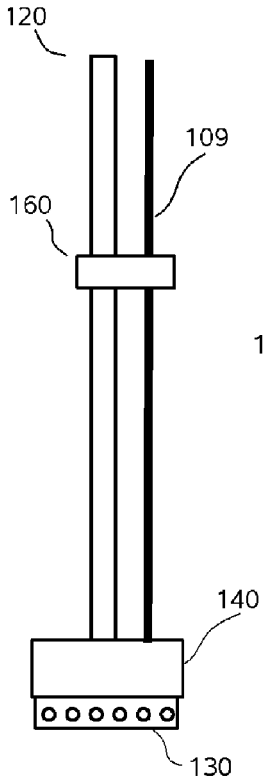
FIG. 2B
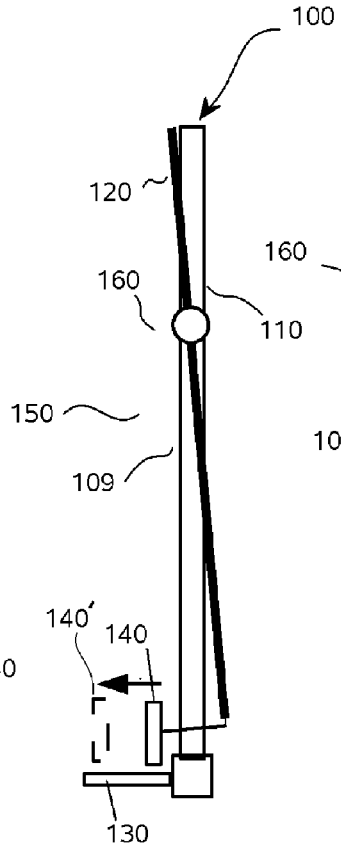
FIG. 2C
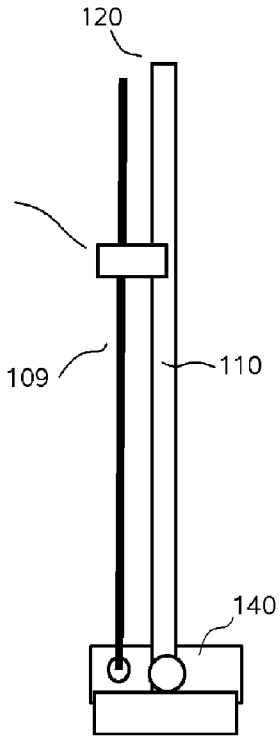
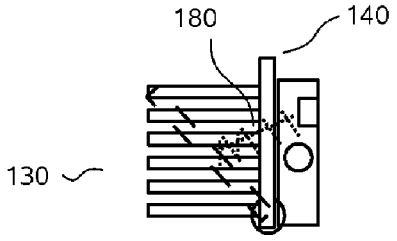
FIG. 2D

FIG. 3A
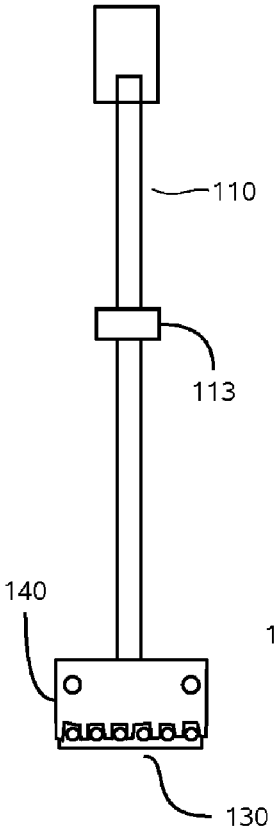
FIG. 3B
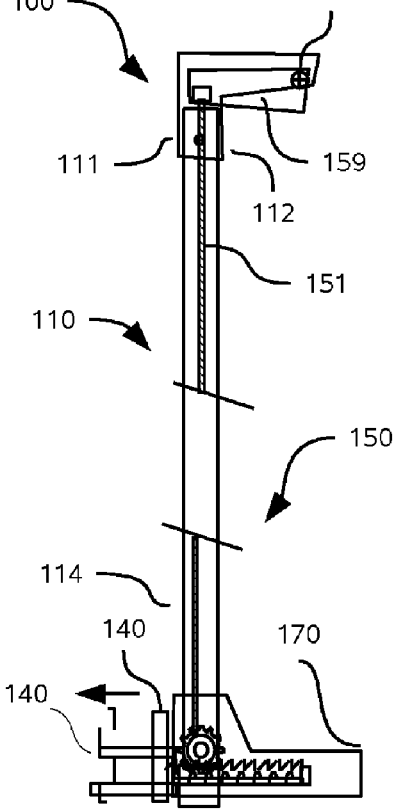
FIG. 3C
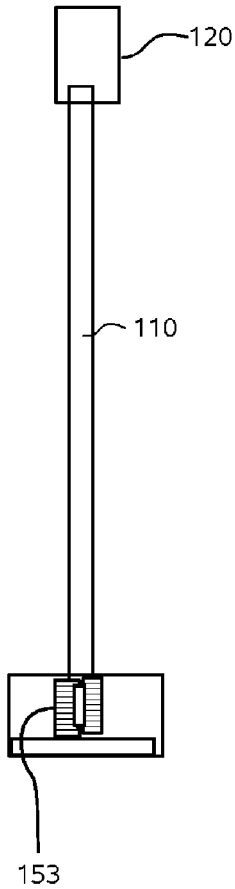
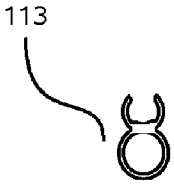
FIG. 3E
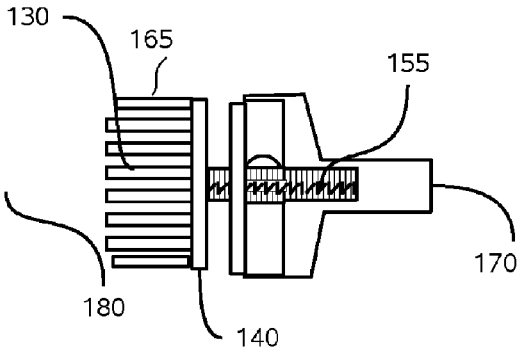
FIG. 3D FIG. 6A
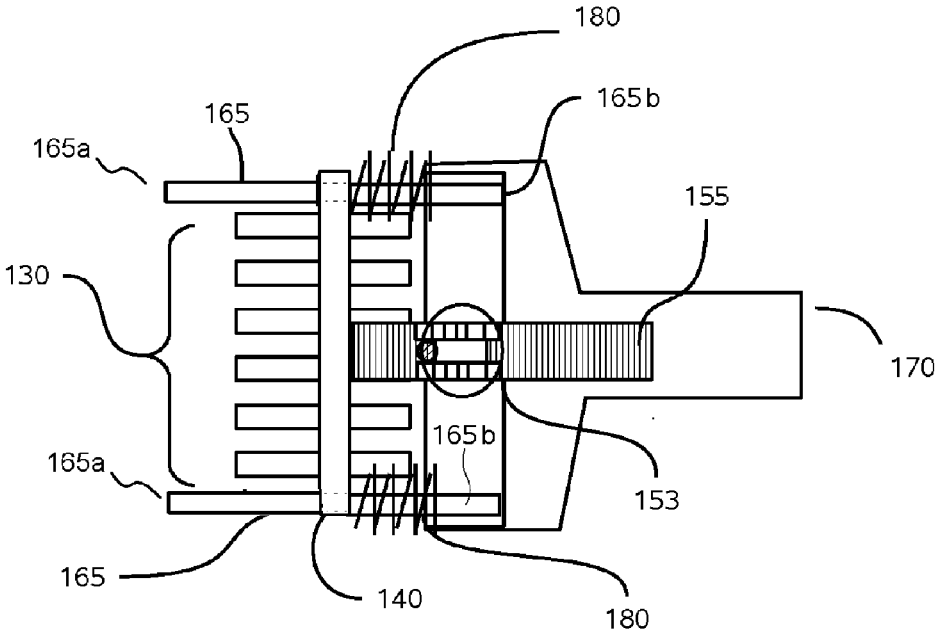
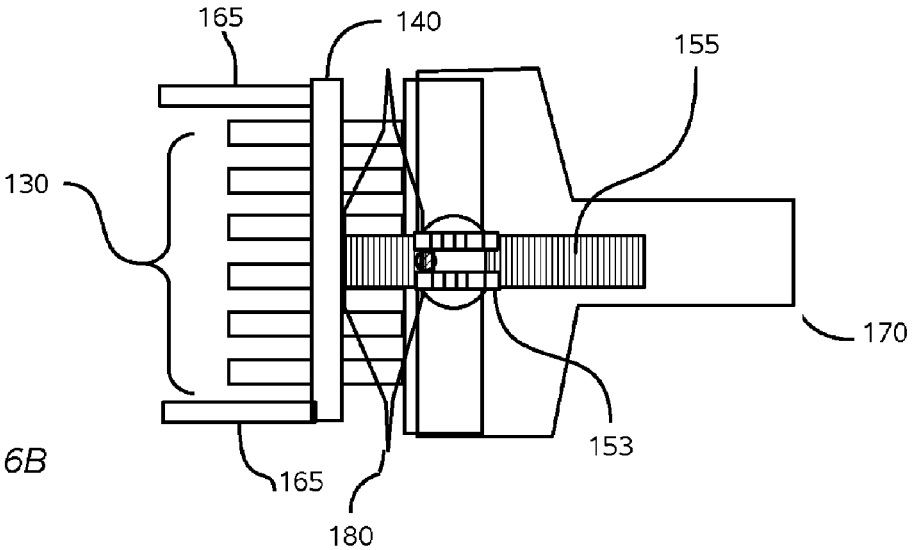
FIG. 6B FIG. 7A
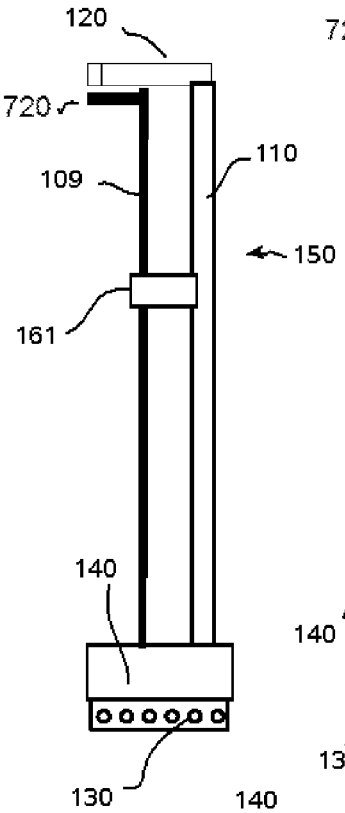
FIG. 7B
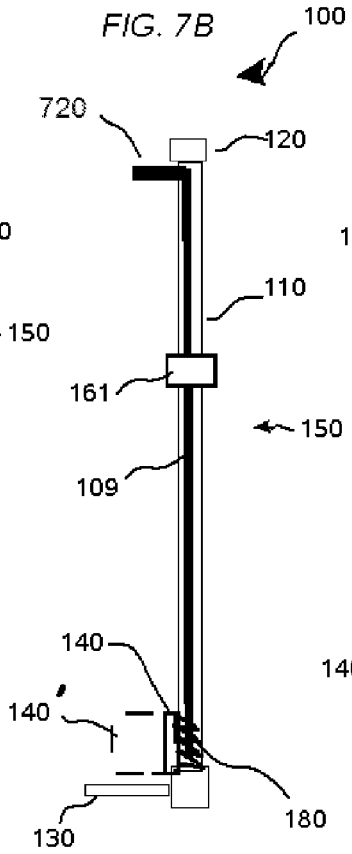
FIG. 7C
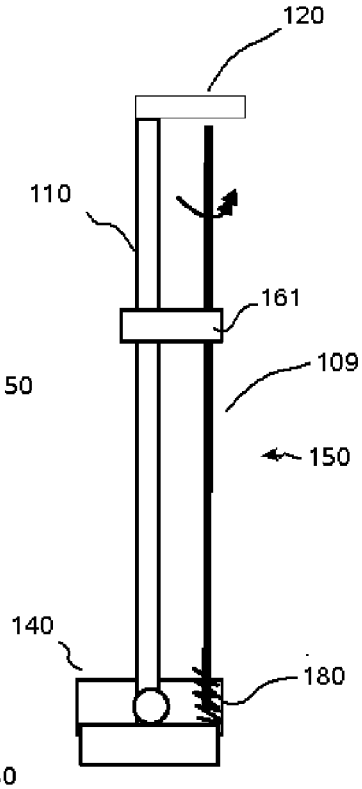
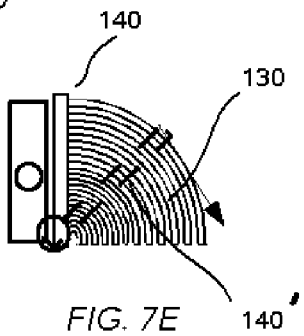
FIG. 7E
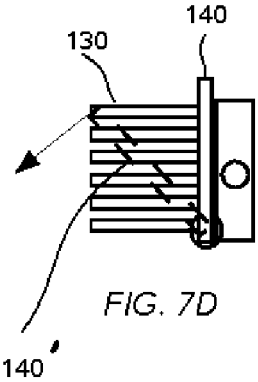
FIG. 7D

ANIMAL WASTE DISPOSAL TOOL

CROSS REFERENCE TO RELATED APPLICATIONS

This application is a Continuation-In-Part of U.S. application Ser. No. 13/068,854, filed May 11, 2010, which is now U.S. Pat. No. 8,474,890, issued on Jul. 2, 2013.

The present application is a Continuation-in-Part of and claims the benefit of priority to the U.S. Non-Provisional Patent Application of the same title at was filed on Filed 10 Jun. 2008, having application Ser. No. 12/136/309, now U.S. Pat. No. 8,132,834

The present application is also continuation of and claims the benefit of priority to the U.S. Provisional application of the same title that was filed on 14 Nov. 2912 having application Ser. No. 61/726,153, which is incorporated herein by reference.

BACKGROUND OF INVENTION

The present invention relates to a device for animal waste disposal.

It is desirable and frequently required by law that pet owners promptly remove pet dropping from public parks and sidewalks, as well as from private property, for health reasons, as well as the damage it does to grass and other vegetation.

As many pet owners do not wish to bend over and use papers or plastic bags to remove droppings by hand an array of devices have been developed.

However, many of these prior art device are deficient are deficient in one manner or another as will be discussed below. Virtually all prior art devices attempt to provide a more sanitary means of removing pet waste, that is to avoid contact. Some these prior art devices use one of more scoops to shovel shapes to capture the waste. Frequently, these prior art devices tend to either incompletely remove droppings, or if used to completely remove the dropping also require the removal of surrounding grass and soil, and are hence also injurious to landscaping.

Further, these devices also tend to collect animal waste residue, and hence require regular cleaning and additional maintenance.

If the tools are used move aggressively to remove all residues, more residues tend to stick to the tool. Further, the tool portion that contacts the waste can be difficult to clean.

Accordingly it is a first object of the invention to provide an improved means to remove animal droppings, and particular pet droppings wherein the user/handler need not stoop over.

It is yet another object of the invention to provide such an improved apparatus that can completely remove such animal waste, yet will not damage grass or ground cover.

It is still a further object of the invention to provide such a device having the above attributes, that while capable of completely removing such animal droppings of varying consistency, will not become soiled or clogged and will hence be easier to clean and maintain.

It is another objective of the invention to provide a simple and hygienic means to remove the waste from such a device by collecting it in a sealed bag.

SUMMARY OF INVENTION

In the present invention, the first and other objects are achieved by providing a method of removing animal waste, the method comprising the steps of: providing a tool having a lateral lifting surface at one end, a plate disposed over said lifting surface for sweeping waste off the lifting surface when loaded thereon, wherein the lifting surface and plate are disposed at the end of a shaft, inserting the lifting surface under the waste to be removed, lifting the shaft upward to remove the waste from the ground, transporting the waste to a disposal container, translating the plate over the lifting surface to urge the waste there from whereby it falls in the disposal container.

In a second aspect of the invention other objects are achieved by providing a tool for animal waste removal, the tool comprising a shaft having a top and a bottom, a handle at top of shaft, a container at the bottom of the shaft, the container comprising a front opening, a partial top opening, a plurality of 2 or more apertures distributed on 2 or more sides of the container proximal to the perimeter of the front opening, wherein the shaft is connected to the container on a portion of the container between the front opening and the partial top opening.

A third aspect for the invention is achieved by providing a tool kit for animal waste disposal comprising a first tool comprising: as haft having a top and a bottom, a handle at top of shaft, a lateral lifting surface disposed in a first common plane, said first common plan being substantially horizontal to and coupled to the bottom of said shaft, a plate disposed perpendicular and immediately above said plurality of tines, an actuator coupling said handle to said plate wherein the operation of said actuator via said handle urges said plate to move in said first common plane perpendicular to said lateral lifting surface, a second tool comprising: a shaft having a top and a bottom, a handle at top of shaft, a container at the bottom of the shaft, the container comprising, front opening, a partial top opening, a plurality of 2 or more apertures distributed on 2 or more sides of the container proximal to the perimeter of the front opening, wherein the shaft is connected to the container on a portion of the container between the front opening and the partial top opening, and wherein said lateral lifting surface and said plate of said first tool fit substantially with the front opening of said second tool.

The above and other objects, effects, features, and advantages of the present invention will become more apparent from the following description of the embodiments thereof taken in conjunction with the accompanying drawings.

BRIEF DESCRIPTION OF THE DRAWINGS

FIG. 1A-C are schematic elevations of the front, side and rear respectively of a first embodiment of the invention, while FIG. 1D is a plan view thereof.

FIG. 2 A-C are schematic elevations of the front, side and rear respectively of a second embodiment of the invention, while FIG. 2D is a plan view thereof.

FIG. 3A-C are schematic elevations of the front, side and rear respectively of a third embodiment of the invention, while FIG. 3D is a plan view.

FIG. 3E is a plan view of the clip shown in FIG. 3A at section line E-E.

FIG. 6A is a plan view of an alternative embodiment of the moving plate portion.

FIG. 6B is a plan view of another alternative embodiment of the moving plate portion.

FIG. 7A-C are schematic elevations of the front, side and rear respectively of a fourth embodiment of the invention, while FIG. 7D is a plan view thereof. FIG. 7E is an alternative embodiment of the portion shown in FIG. 7D.

FIGS. 8A and 8B illustrate an alternative embodiment of an actuator, in which FIG. 8A is a perspective view of the lower portion of the device from slightly above the side and FIG. 8B is a cut away perspective view of a portion of the interior mechanism of the actuator from slightly above and behind the lower portion of the device.

FIG. 12A is a perspective exterior view of an alternative embodiment of the actuator mechanism at the handle or trigger end, whereas

DETAILED DESCRIPTION

Figure 4:
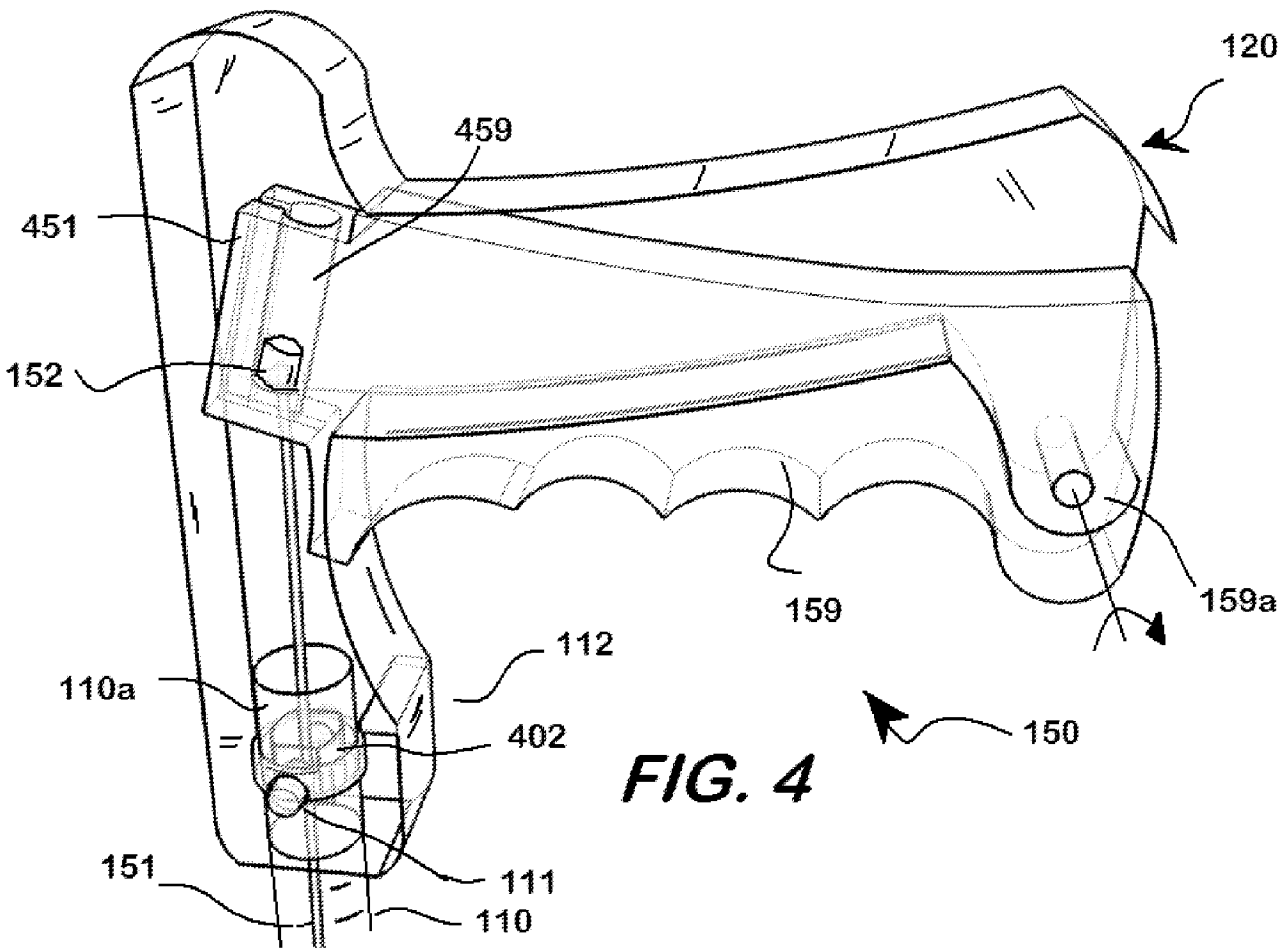
FIG. 4 is a perspective view of the interior of the actuator mechanism at the handle trigger end.

Referring to FIGS. 1 through 14, wherein like reference numerals refer to like components in the various views, there is illustrated therein a new and improved Animal Waste Disposal Tool, generally denominated 100 herein, and an animal waste collection tool 200.

In accordance with a first embodiment of the present invention, FIG. 1 illustrates tool 100 having a shaft 110 having a top 110*a* and a bottom 110*b*, with a handle 120 generally disposed toward the top of shaft 110. At the opposing or bottom end 110*b* of shaft 110 a plurality of tines 130 are disposed in a first common plane 131, said first common plane being substantially horizontal to and coupled to the bottom of said shaft. A plate 140 is disposed perpendicular and immediately above the plurality of tines 130

An actuator 150 coupling the handle 120 to plate 140 wherein the operation of said actuator 150 via said handle 120 urges said plate 140 to move in the common plane perpendicular to the plurality of tines 130. Plate 140 is shown in alternative position in broken lines and labeled 140' in the Figures.

It should be understood that is more preferable that each of the embodiments also comprises a spring biasing mechanism 180, such as leaf spring(s) coils springs and torsion springs and the like, as shown in FIGS. 6A and 6B, as well as FIG. 7. In particular, it is preferably a torsion spring when plate 140 rotates about or adjacent to shaft 110 in FIG. 5. The spring 180 preferably supplies a constant and controlled minimum force to eject waste off the tines 130.

As shown in FIG. 1, the actuator mechanism 150 alternatives include a rotating bar connecting the plate to the handle, as well as a bar that slides in and out, each extending from the plate to the top of the shaft. The top of this bar is the handle. The bar can be connecting to the shaft at some intermediate position by a slide or pivot mechanism. The slide or pivot can include a biasing means. Actuator may include a cable actuator and/or a coupling to magnify the plate displacement with respect to the handle displacement. Alternative actuator mechanisms can be any found in the prior art search.

The tines 130, being spaced apart with gaps is readily inserted under the waste matter being able to slide through blades of grass and other vegetative matter. Accordingly, when the operator lifts the tool 100 upward, they pick up the waste but also do not damage the grass as it ready slips through the tines. Alternatively, the tines may be used to lift solid waste our of a container containing a granulated absorbent material, such as the granular absorbent escapes through the slots between adjacent tines, but the larger solid waste is supported on the tines for subsequent and facile removal as described below.

Accordingly, it will now be appreciated that the device 100 improves sanitation and hygiene by complete removal without residue on the ground as animal waste can be removed without direct contact. Further, the user of the device need not stoop over to remove waste, nor carry, buy or find plastic bags is general purpose waste receptacle are in the general vicinity. The tine arrangement minimizes the potential for leaving waste residue on the tool, as the contact therewith is minimizes and not pressure is asserted to squeeze the waste onto the tool other than its own mass. Likewise, as the plate 140 slides across the tines 130, and will readily remove the waste there from without leaving significant residue. Further, the tool 100 portions, which is the tines 130 and the plate 140 that contacts residue, are easy to clean.

It should be appreciated that the device can be deployed to remove solid waste work from a cat litter box as well, with the added and advantage of eliminating a need to bending over. Further, although pregnant women are not supposed to come in contact with cat waste, which presents a risk of exposure toxoplasmosis, use of the device is believed to significantly mitigate this risk as compared with the prior art methods of bending over to use a small hand scoop/tool, or lifting the box to access the contents.

In FIG. 1 the actuator 150 deploys another or secondary shaft 109 coupled at the bottom to the plate 140 and at the top to the handle 120. The secondary shaft 109 and slides laterally with respect to the main supporting shaft 110, remaining parallel thereto. Various combinations of spring 180 elements shown in other embodiments can be used to bias the plate 140 to either alternative position. Further, the secondary shaft 109 is optionally supported at the center as shown, but more preferably at both the top and bottom by slots or channel that extend from the main shaft 110, so that it is restrained to move laterally.

In FIG. 2 the actuator 150 is another or secondary shaft 109 coupled at the bottom to the plate 140 and at the top to the handle 120. The secondary shaft 109 pivots about the center of the main supporting shaft 110, via a rotary coupling 160, thus the movement of handle 120 forward, retracts plate 140, while the backward movement propels it forward along with plate 140 to push waste matter off the tines 130. Various combinations of spring 180 elements shown in other embodiments can be used to bias the plate 140 to either alternative position. The spring 180 elements can be at either the plate 140 end, the handle end 140 or a torsion spring in the rotary coupling 160.

FIG. 3 illustrates a more preferred embodiment that further comprises rails 165 that extend above and parallel to the plurality of tines 130. In various other embodiments the rails 165 also help stabilize the plate 140, acting as plate guides. However, the primary function is to insure that waste cannot fall or slip sideways off the tines 140 was it is lifted off the ground. Preferably, the plate 140 has a lower portion with fingers that are inter-digitated to extend into the gaps between the tines 130.

In the embodiment of FIG. 3, the actuator mechanism 150 comprises a cable 151 that is responsive to squeezing the trigger 159 portion of handle 120. The cable 151 terminates at the upper portion with a capping cylinder 152, shown in more detail in FIG. 4 in a transparent perspective view. The capping cylinder 152 and the top portion of the cable 151 are inserted into the opposite end of the trigger 159 which has with a downward oriented hole 459 and a side slit 401 that extends laterally to reach the entire length of the hole. The hole has an upper portion that is wide enough to retain the capping cylinder 152. This upper portion is followed by a lower portion that is just wider than the cable, but narrower than the capping cylinder; so that when the cable is inserted in the slot and pulled downward (or the block pulled upward) the capping cylinder 152 will be retained in this hole in the trigger 159.

Figure 5:
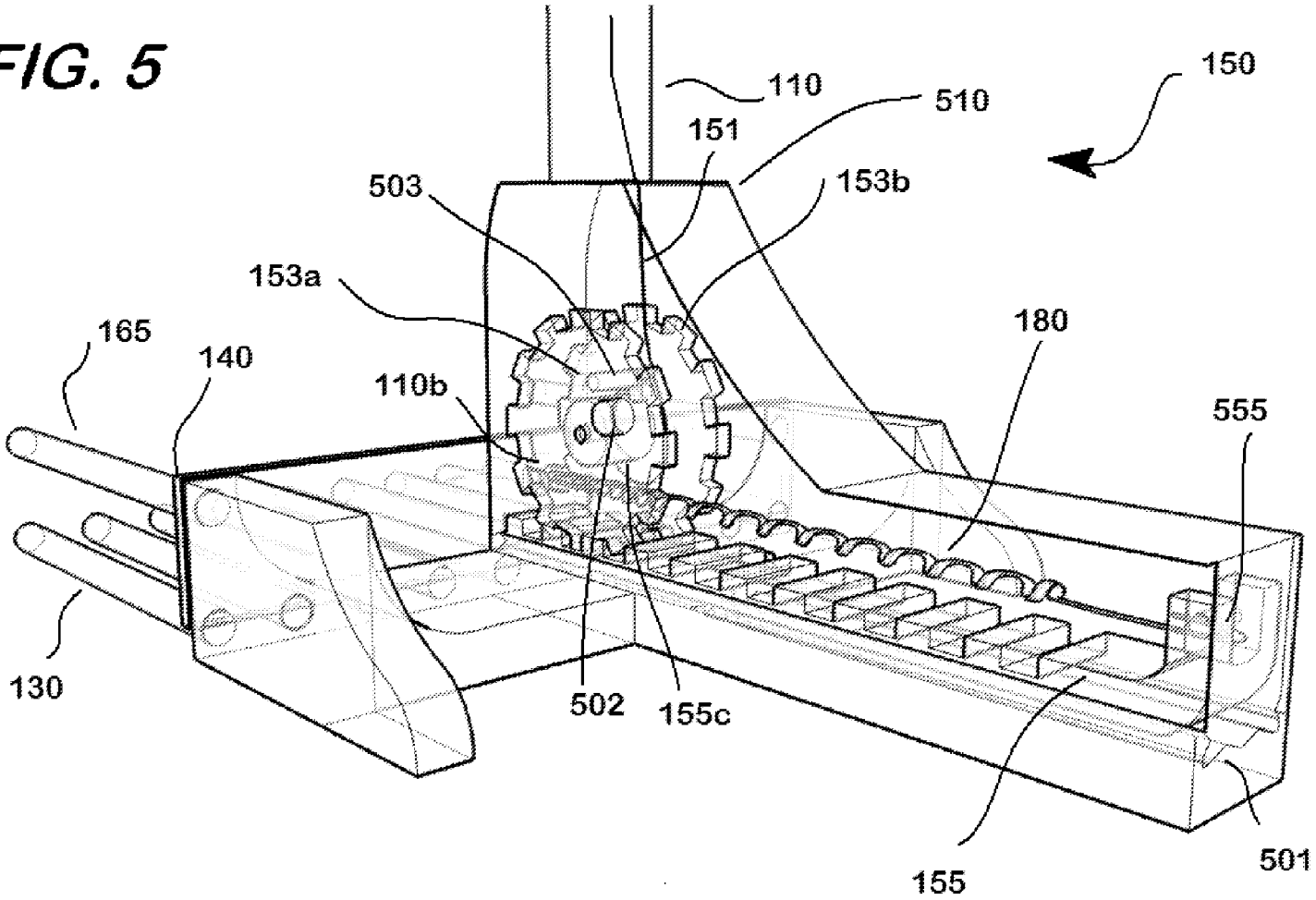
FIG. 5 is a perspective view of the interior of the actuator mechanism at the bottom of the shaft with the tines and moving plate.

As shown in detail in FIG. 5, the opposite end of the cable 151 at the base of shaft 110, that is side 110*b*, is connected in rotary engagement with a round gear 153 that is divided into two axially separated portions which are round gears 153*a* and 153*b*. The intervening axle 155*c* is thus driven by the cable 151 via the grip handle trigger 159. The trigger 159 mechanism has a rotary coupling 159*a* at the end of the hand grip so that when it is squeezed and pulled backward into the handle the cable 151 is pulled upward. Then, at the opposite end of the actuator 150, the cable 151 rotates the round gear 153 and urges the plate 140 backward, thus compressing the spring 180.

The cable 151 is physically attached to the intervening axial 155*c*. Further, at least one of the round step gears 153*a* and 153*b* has an off center external projection 502 on its outside that is intended to engage a similar projection 503 extending inward from the case 510, and thus limit the range of rotary motion of the round gear 153 to the intended travel range of the cable 151.

Each of the axially separated round step gears 153*a* and 153*b* simultaneously engage tracks of flat gear 155. By flat gear we mean the arrangement of gear teeth in a linear co-planar arrangement. The portion of the flat gear 155 most distal from plate 140 has a vertical portion 555 for supporting a spring 180. The end of spring 180 distal from plate 140 is connected toward the top of this vertical portion. The flat gear 155 fits and slides in the rectangular well in the base having a series of tracks 501 in the bottom that are in a triangular shape, making limited contact with the reverse side of the flat gear, opposite the teeth thereof, to minimize friction. However, these are merely the currently preferred embodiments of the flat gear and well, which need not have the shapes or contact areas shown, as other shapes such as circular, oval and trapezoidal are possible. The spring 180 that biases the plate 140 with respect to the bottom 110*b* of the shaft 110 extends above and in the same direction as the track gear, being below the intervening axle 155*c*, and thus in the gap between the round gears 153*a* and 153*b*.

The proximal end of the flat gear 155 is connected to the reverse side of plate 140, which is the side facing shaft 110. The proximal end of the spring 180 is connected or coupled to the base near the bottom 110*b* of shaft 110. The base thus has an aperture so that the flat gear can translated forward and backward as the actuator 150 is engaged.

Further, the handle 120 rotates for left and right handled operation, preferably includes a locking pin 111 in the shaft 110, as the handle has an axial extension 112 that surrounds the upper portion 110*a* of shaft 110, a common lateral locking pin 111 extends through a pair of common lateral holes to prevent the handle 120 from sliding on shaft 110. The locking pin 111 in spring 402 biased detent mechanism that prevent the handle extension portion 112 from rotating with respect to shaft 110 until it is depressed. Locking pin 111 also enable handle 120 to rotate 180 degrees for left and right handled operation. A clip 113 on shaft 110 for holding the shaft on an associated pan with handle. Preferably, but not exclusively, plate 140 moves in the direction of the tines 140 principle axis 145.

As shown in FIG. 5, spring 180 is normally biased to urge the plate 140 toward the end of the tines 130. Then, when the trigger 159 is squeezed and pulled back into the handle, the upward movement of the cable 151 will rotate the round gear 153 thus, causing the plate 140 to move inward from the end of the tines 130 back toward the case 510. It should be appreciated that another alternative embodiment is attaching a spring to the farthest right side of housing of the case 510 to the vertical extension 555 which will bias the plate 140 and flat gear 155 back into the case 510. Then, when the trigger 159 is squeezed and pulled back into the handle, the upward movement of the cable 151 will rotate the round gear 153 thus, causing the plate 140 to move outward to the end of the tines 130.

Alternatively, as shown in embodiment of FIGS. 7D and 7E, the tines 130 are optionally linear or curved respectively, curves tines being preferable when the plate 140 rotates rather than translates in a complete lateral fashion.

In FIG. 6A, guide rails 165 are shown as also having rearward extending appendages 165*b* to plate 140, spaced above tines 130 attached to side 110*b* of the shaft 110. More preferably, a spring 180 is coiled around each guide rail appendage 165*b*, which are behind plate 140 to avoid fouling. Further, the ends 165*a* of guide rails 165*b* extend through mating holes in the base about shaft side 110*b*, and thus stabilize plate 140. FIG. 6B illustrates one alternative embodiment for using a leaf spring 180, as opposed to ordinary coil springs 180 and 180' in FIG. 6A. While leaf spring 180 is oriented with the wide side vertical, it is also possible to deploy leaf springs of other shapes and orientation. Note that the guide rails 165 are attached to the front of plate 140, moving forward therewith. This alternative embodiment can be used with any of the actuator embodiments described herein.

FIG. 7A-C are schematic elevations of the front, side and rear of a fourth embodiment of the invention, and secondary shaft 109 attached to edge of the plate 140 via a vertical rotary coupling 161. Thus the upper portion of the secondary shaft 109 preferably includes a horizontally extending handle 720 that together with the handle 120 essentially form a trigger mechanism for actuator 150. The plate 140 translates in the plane of the tines by rotating across the tines 130.

In FIG. 7D, which is an alternative embodiment of the portion shown in FIG. 7C, the tines 130 are curved following the curving track of plate 140. It should be apparent that this configuration of curved tines 130 may also be preferable to use with the actuator embodiment shown in FIG. 2. Further, in any of the embodiment the tines 130 and guide rails 165 may have cross sectional shape is optionally round, square, inverted triangles (point up), or flattened or oval. Further, plurality of tines 140 can be replaced with a large flat rectangle lifting plate having the same dimensions, although this would be less desirable for removing animal excrement from grass surface. The plate 140 can move from the handle side of the tine array 130 to the tip thereof in response to the actuator 150, or in the opposite direction so that the rest position of the plate is either at the edge of the tines or at the connection between the tines and the shaft.

Figure 8A:
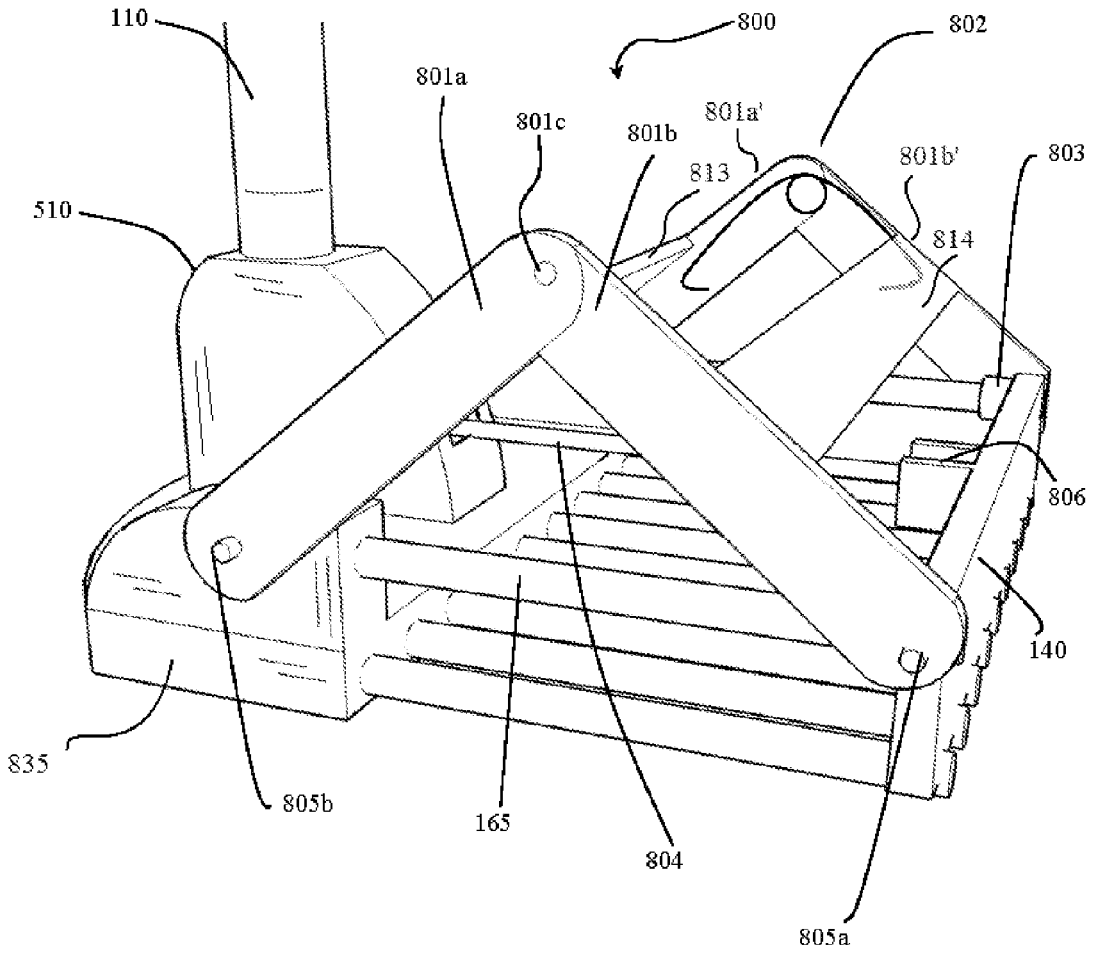
Figure 8B:
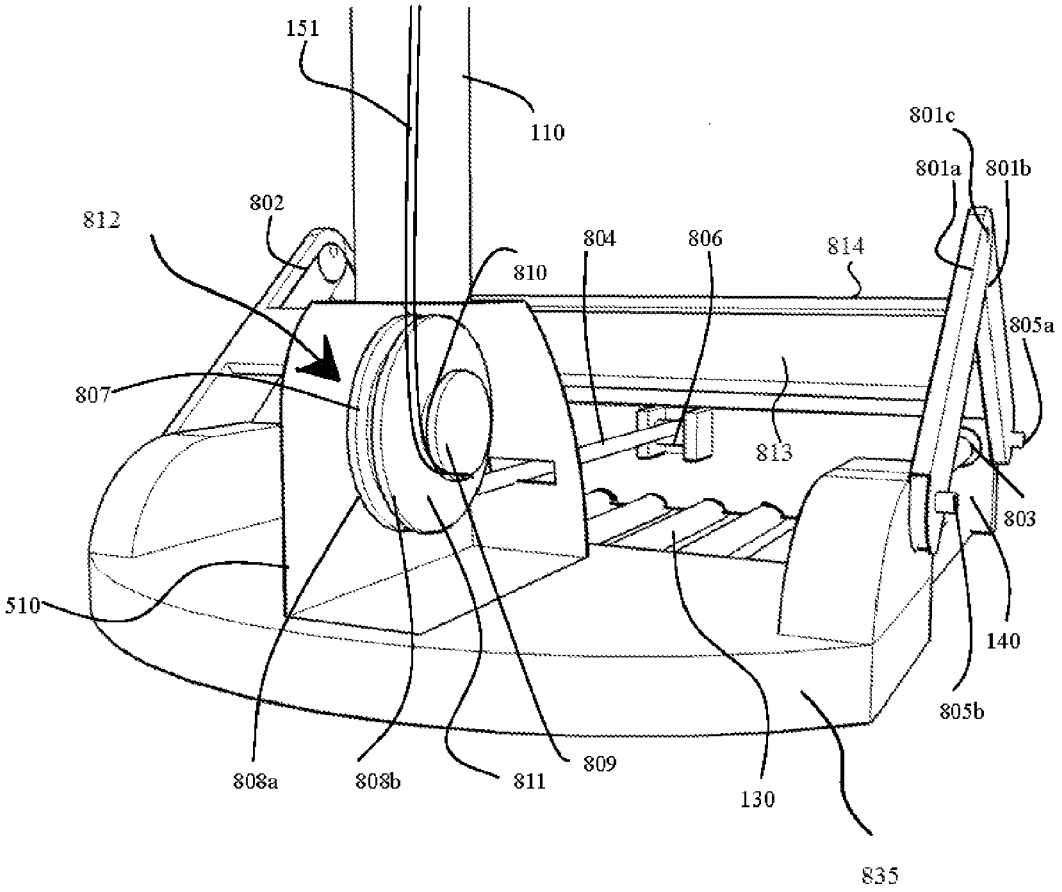
Figure 9C:
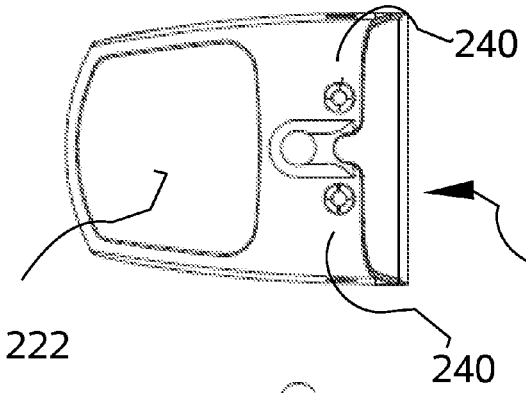
FIG. 9C is a plan view of the embodiment of FIGS. 8A and 8B.
Figure 9B:
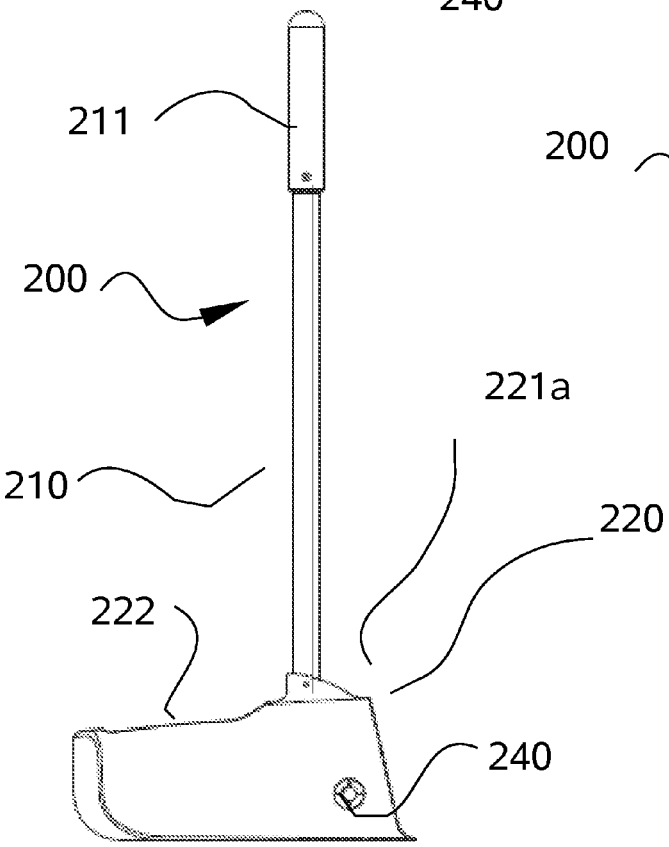
FIG. 9B is a side elevation of the embodiment of FIG. 8A.
Figure 9A:
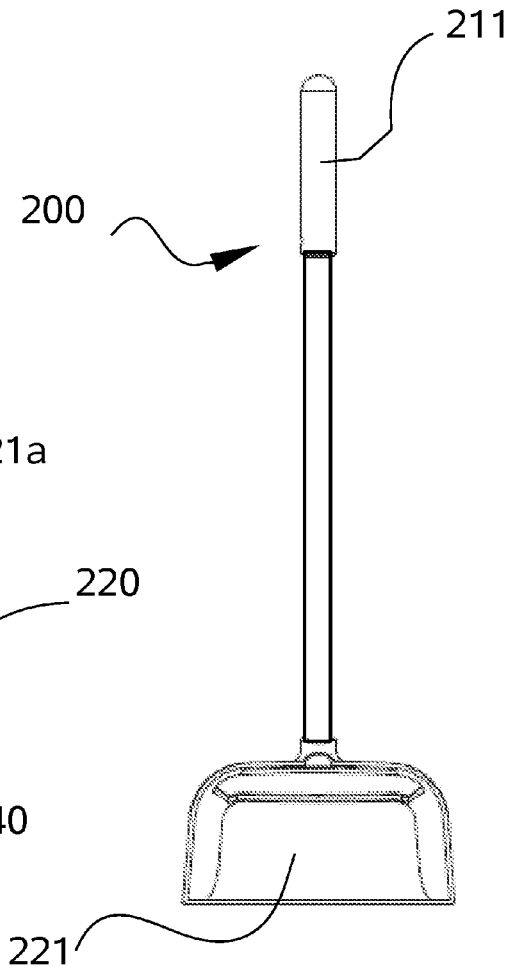
FIG. 9A is a front elevation of a fifth embodiment of the invention for a container for receiving animal waste form the tool of the other embodiments.
Figure 10:
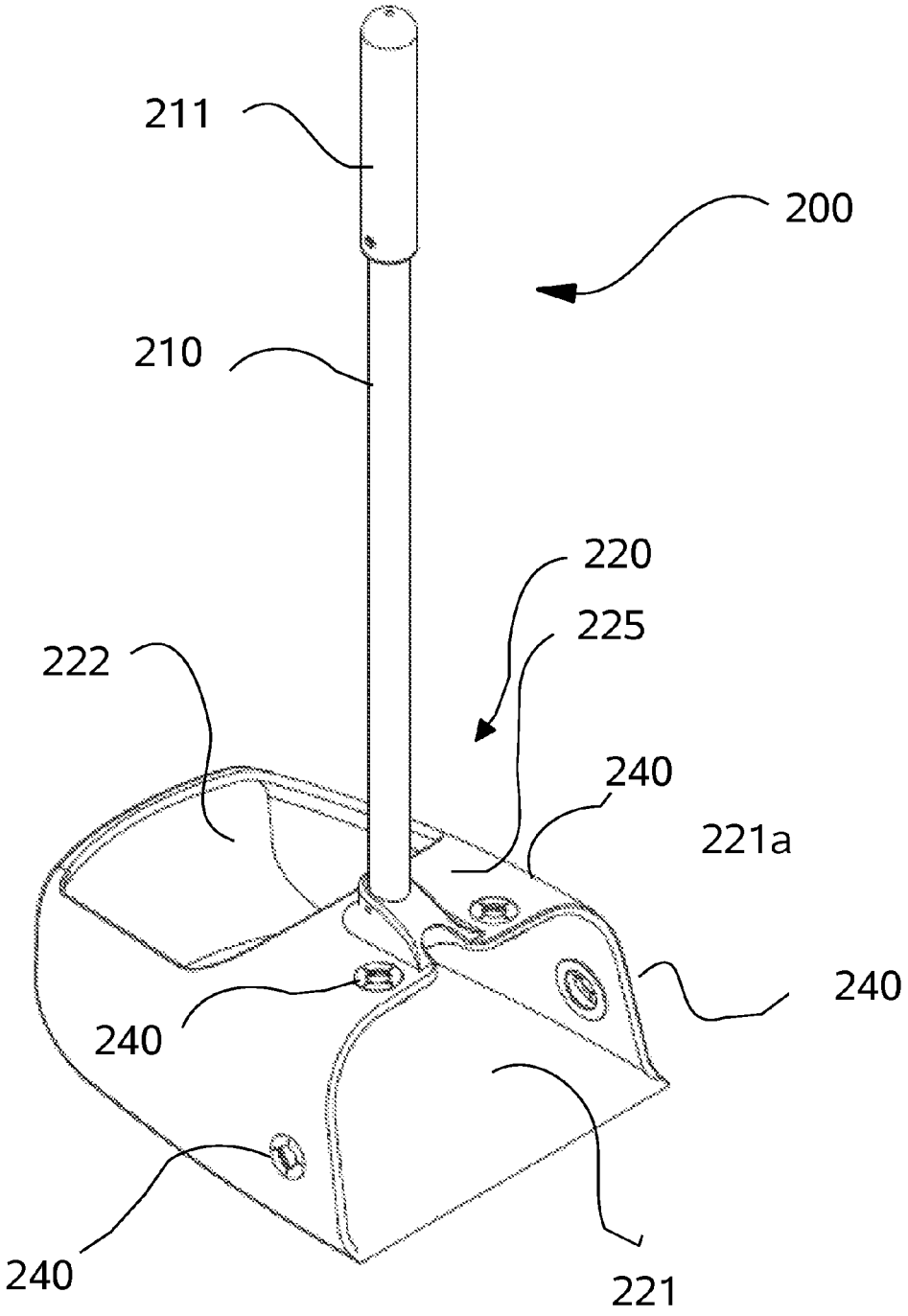
FIG. 10 is a perspective front view of the container of FIG. 9
Figures 11A, 11B:
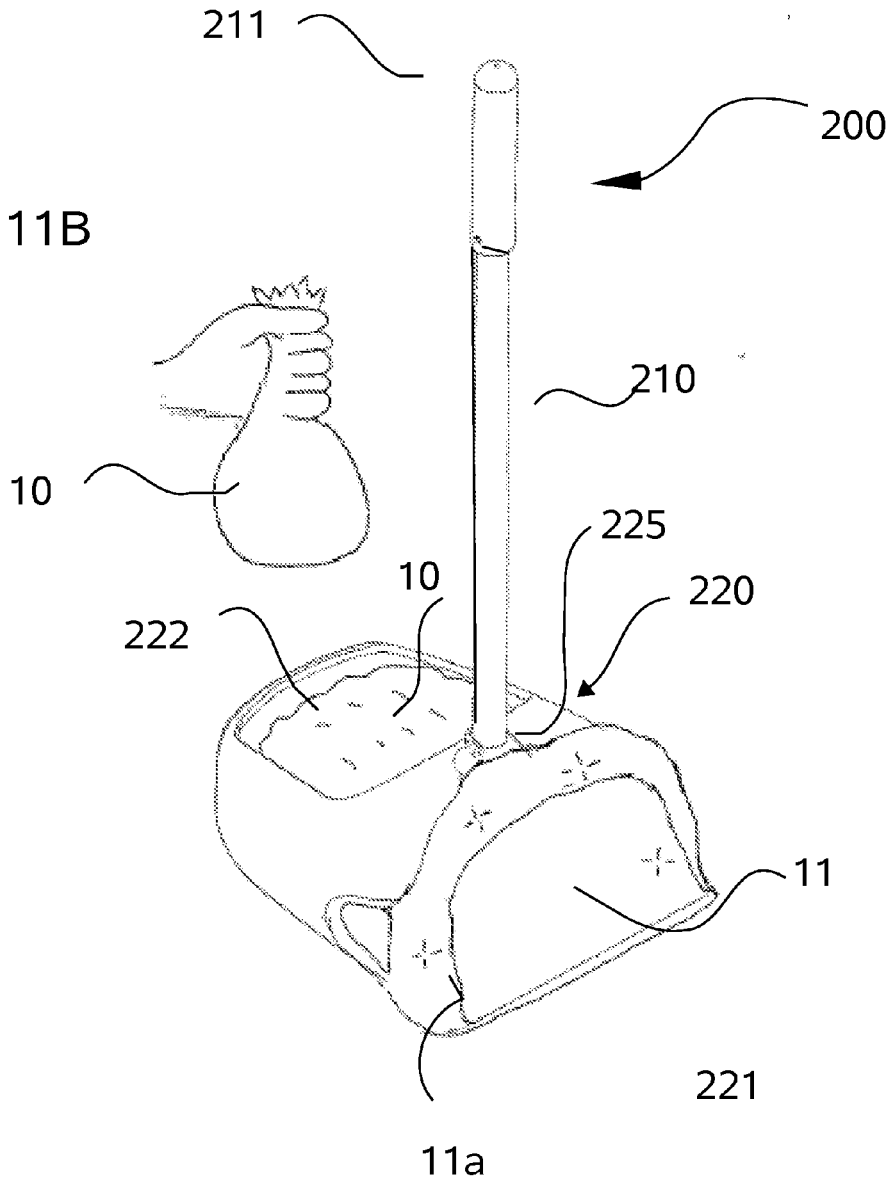
FIG. 11A is a perspective front view of the container of FIGS. 8 and 9 with a plastic waste collecting bag inserted therein.
FIG. 11B shows the plastic waste collection bag after removal.

FIGS. 8A and 8B illustrate an alternative embodiment for a lower portion of the actuator wherein the portion thereof coupled to the flat plate 140 deploys pairs of hinged arms 801*a* and 801*b* that unfold to translate the plate 140 across the tines 130. The pairs of hinged arms 801*a* and 801*b* on one side of tine array 130 are connected by cross members 813 and 814 to the pairs of hinged arms 801'*a* and 801'*b* on the opposite side of the tine array. Arms 801*a* and 801*b* are connected in rotary engagement by a pin 801*a*, as are hinged arms 801*a*' and 801*b*'

In FIG. 8A, the opposite end of each hinge arm 801*b* is connected the near side of plate 140 in rotary engagement via another pin 805*a*, with arm 801*a*' likewise connected to the opposite side of plate 140 via another rotary pin connection.

The opposite side of hinge arm 801*b* and 801*b*' are connected to the near and far sides of the wide base 835 in rotary engagement via pins 805*b*. The base 835 is orthogonal to shaft 110 and has about the same width as plate 140.

The plate 140 has two guide rail sleeves 803 located at opposite ends which enable the plate to slide along the guide rails 165. Pairs of torsion spring 802 are coupled to the interior walls of hinge arms 801*a* and 801*b* to bias the rotation there between at pin 801*c* and 801*c*', normally urging the plate 140 toward the end of the tines 130.

As shown in detail in FIG. 8B, a pulley 812 is connected in rotary engagement at the base of shaft 110. The opposite end of the cable 151 that is attached to the trigger 159 is attached to the axle 810 of pulley 812. Attached to the outer wall of axle 810 is a cable guide 809 that will prevent the cable 151 from slipping off. A second cable 804 is wrapped around protruding post 806 for attachment to the plate 140. The opposite end of the cable 804 is attached to a second axle 807, which has co-axial cable guide 808*a* and 808*b* to prevent the cable 804 from slipping off laterally. The intervening axle 810 is thus driven by the cable 151 via the grip handle trigger 159. The trigger 159 mechanism has a rotary coupling 159*a* at the end of the hand grip so that when it is squeezed and pulled backward into the handle the cable 151 is pulled upward. Then, at the opposite end of the actuator 800, the cable 151 rotates the pulley 812 and urges the plate 140 backwards, via the second cable 804 that is attached to the plate 140, thus compressing the spring 802.

FIGS. 9A-C, 10 and 11A-B illustrate another embodiment of the invention in a second tool 200 which optionally cooperates with tool 100 to collect and store animal waste that is pushed off of tines 130 by plate 140.

Tool 200 comprises a container 220 having a front opening 221 and a preferably a rear top opening 222. An elongated upward extending shaft 210 is disposed at the top 225 of the container 220 between the rear top opening 222 and the upper edge 221*a* of the front opening 221. Preferably, as the upper end of shaft 210 is meant to be held by the user, it includes a soft or ergonomic grip portion 211. A plastic bag 10 is preferably inserted into the body of the container 220 so that its open side 11 can be enlarged to extend the top edge 11*a* beyond the perimeter of the front opening 221. The bag 10 is secured in the container 220 by either the top edge 11*a* or parts of the immediately adjacent side portion inserted into a plurality of 2 or more apertures 240 distributed on 2 or more sides of the container proximal to the perimeter of the front opening 221. Preferably, the apertures 240 include a rubber gasket on the inner surface, as shown. The friction between the gasket of the apertures 240 and the sides of bag 10 that are folded together to fit in the apertures 240 provides sufficient holding force. It should be appreciated that slot, clips and like other hold down mechanism can be provided in place of the apertures 240 and still obtain the benefits thereof.

Preferably tool 200 is appropriately sized for use with tool 100 to collect animal waste there within. Specifically the front opening 221 of container 220 of the collection tool 200 is intended to be wider than the plate 140 and tines 130 of the tool 100, and the depth of the container from the front opening 221 to the opposite closed side deep enough to largely accommodate a substantial portion of the length of the tines 130 so that when waste is swept off of the tines 130, it is deposited in the bag 10.

Further, rear opening 222 then facilitates removal of the bag 10 with waste without contaminating the user/operator or the container portion 220, as the outside of the bag 100 is readily grasped through this rear opening 222, and closed with the hand, and pulled out in a state ready for disposal in a proper trash receptacle as shown in FIG. 10B.

In a preferred embodiment the tools 100 and 200 are provided in the form of a collection kit. In a more preferred embodiment, the kit deploys a connector, such as clip 113, to hold the shafts 120 and 220 together for transport and storage.

FIG. 12A-B, FIG. 13 and FIG. 14 illustrate additional alternative and preferred embodiments of the invention having an improved actuator mechanism 150, which comprises a cable 151 that is responsive to squeezing the trigger 159 portion of handle 120. The upper end 151*a* of the cable 151 terminates within the shaft 110 or the interior of the handle 120 at an internal post 114 but continues upward to wrap around a cylinder 1352 in the trigger 159 that is distal from the pivot axis 159*a* of trigger 159. Cylinder 1352 is disposed with the principal axis co-oriented with 159*a* (out of the plane of the paper in FIG. 13) and hence preferably rotates and guides cable 151 acting as pulley with respect to increasing the throw or movement of the distal end 151*b* of cable 151 that is attached to the plate 140. Hence, a relatively modest rotation of the trigger 159 provides a larger movement of plate 140 allowing a deeper lifting surface deploying longer tines 130 or their functional equivalent.

In particular, in a preferred embodiment of the invention squeezing of the trigger 159 portion of actuator 120 raises the portion of the handle 120 having cylinder 1352 by 1 to 1½ in. moves the plate 140 backward over the lifting surface or tines by about 3 inches. By exposing a larger portion of the lifting surface or tines via the trigger, larger waste can be removed by the tool 100.

Figure 12A:
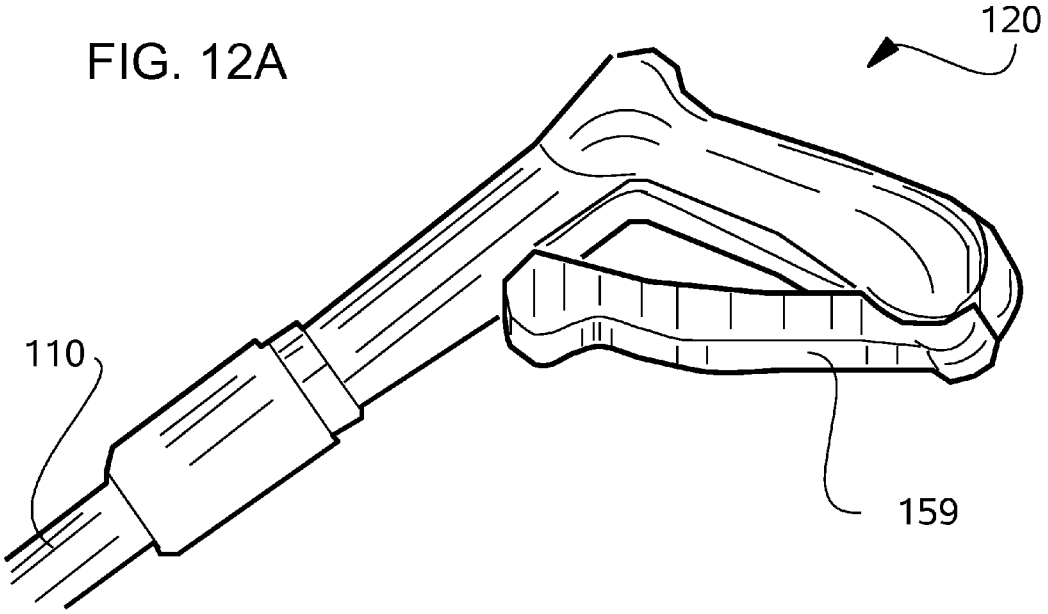
Figure 12B:
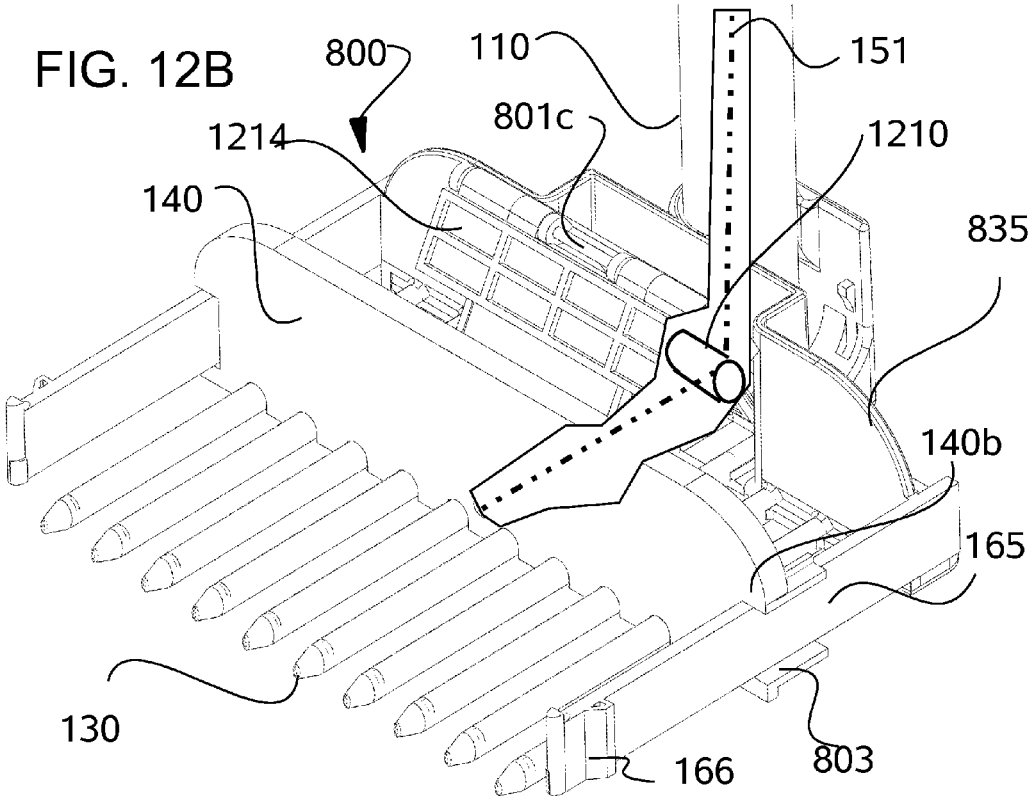
FIG. 12B illustrates in a perspective view of the lower portion of the device from slightly above the front and side thereof.
Figure 13:
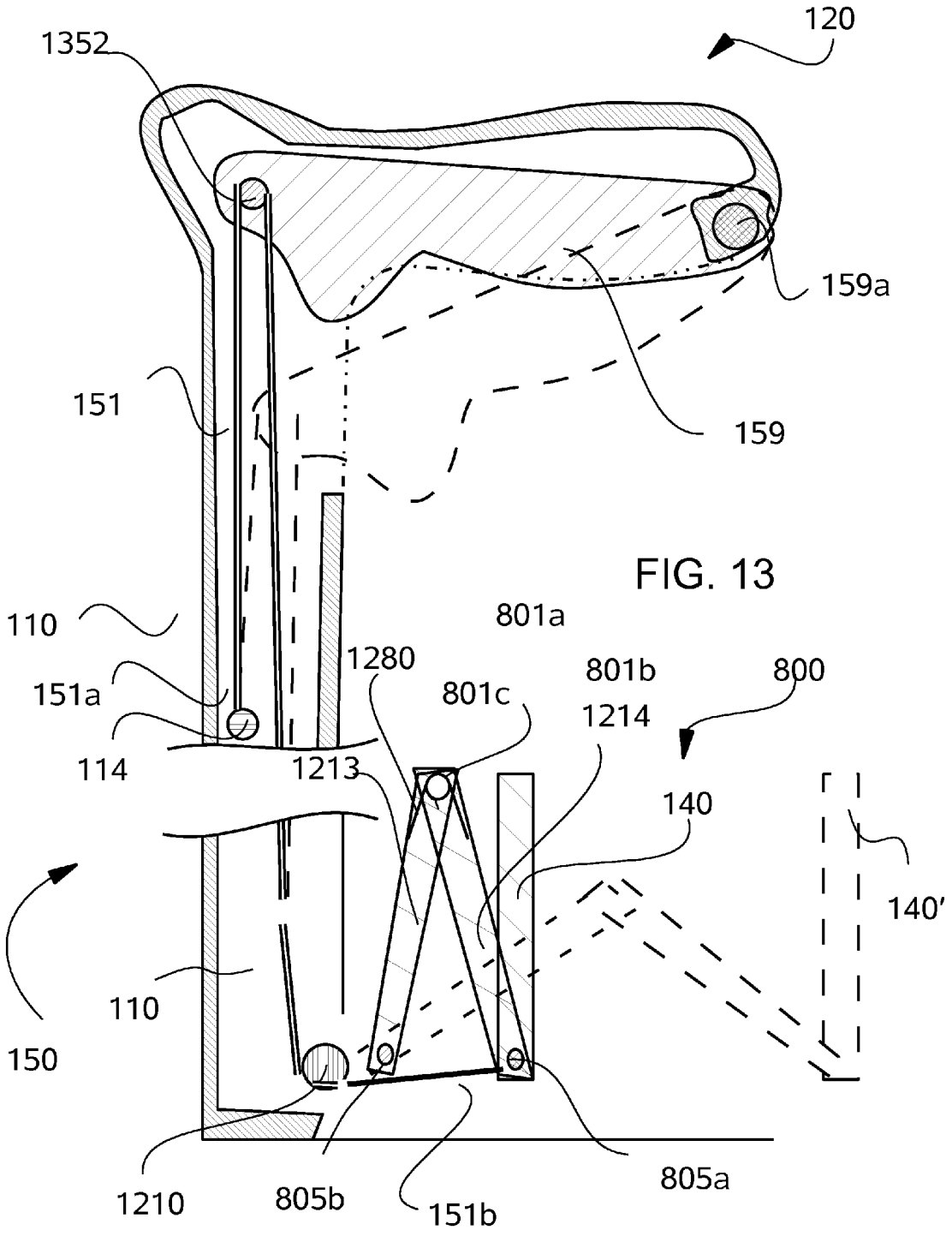
FIG. 13 is a schematic cross-sectional elevation view of the actuator in FIGS. 12A and 12B depicting the configuration of the cable coupling the movement of the trigger to the translation of the plate.
Figure 14:
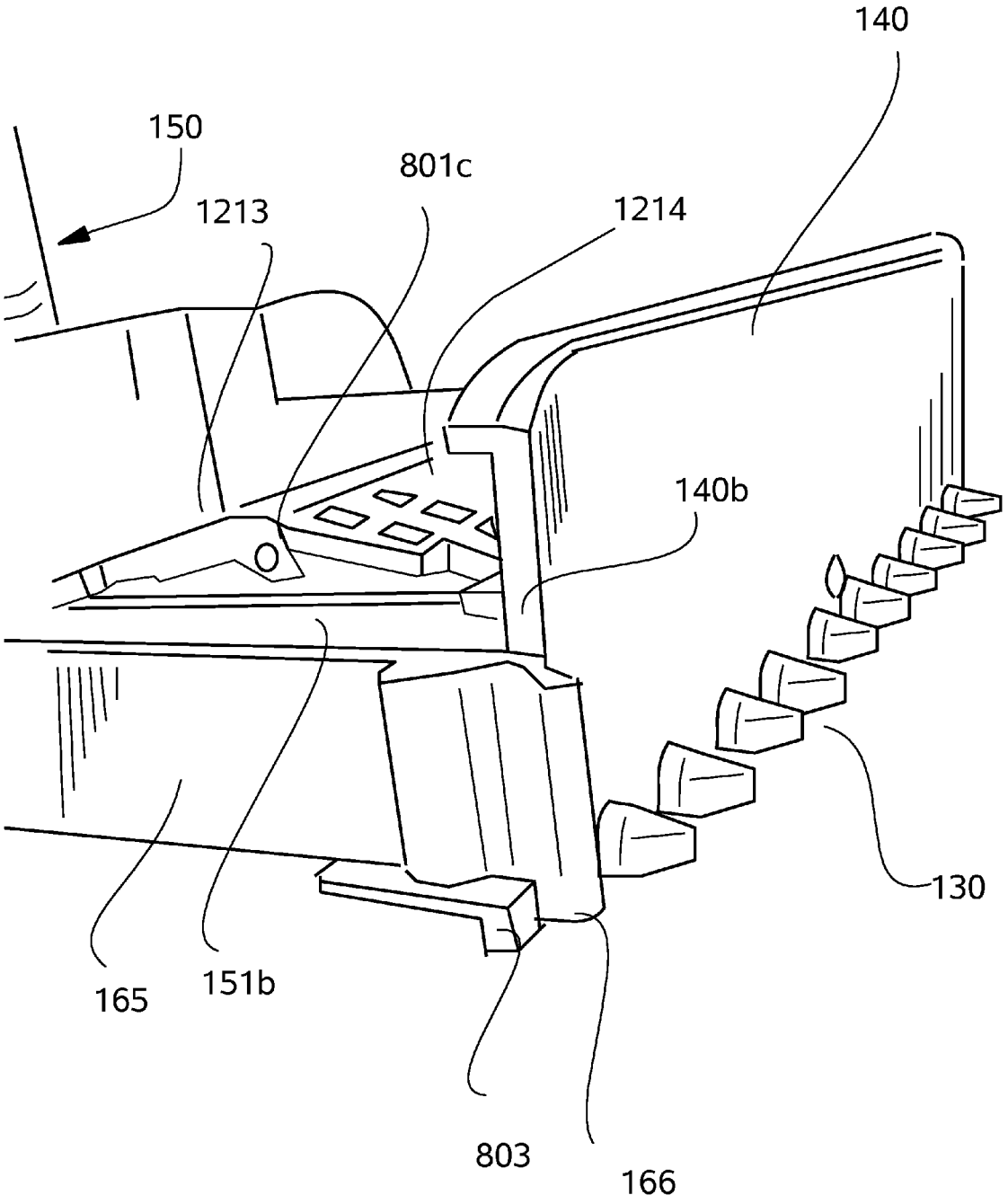
FIG. 14 is a perspective view of the lower portion of an alternative embodiment of the device shown in FIG. 12A, FIG. 12B and FIG. 13.

Rather than rotating a gear, the distal or terminal end 151*b* of cable 151 is directly attached to the plate 140, as shown in FIG. 13. FIGS. 12B and 13 illustrate a portion of the cable 151 (between the vertical portion coupled to the trigger 159 by cylinder 1352 and the distal end 151*b* connected to plate 140) that either wraps partially around or is engaged as a pulley with cylinder 1210. Cylinder 1210 when acting as a pulley and rotating with the movement of cable 151 is in rotary engagement at the base of shaft 110. Cylinder 1352 is optionally replaced with a pulley Further, the plate 140 optionally has one or two guide rail sleeves 803, preferably located at one opposite sides such that each engages the opposing guide rails 165 on sides of plate 140, and enable the plate 140 to slide along the guide rails 165. The guide rails 165 are also preferably bar shaped and have an end stop 166 that extends beyond the edge or margin of sleeves 803. In the embodiment of FIG. 12B, each guide rail sleeve has an upper and lower portion that respectively engage or wrap around the upper and lower portion portions of the guide rails 165, that is contacting the guide rail 165 on 3 surface, the inside (which contacts the edge 140*b* of the plate 140) the upper or lower surface and a part of the outside surface. In the embodiment of FIG. 14, the guide rails sleeves 803 consist only of the lower portion that engages the lower portion of the bar shaped guide rail 165. As in FIG. 12B, a portion of the end stop portion 166 of guide rail 165 extends beyond the end surface of the guide rail sleeves 803.

As shown in FIG. 13, the plate 140 is urged backward from the phantom position 140' by the squeezing the trigger 159 to oppose the restoring force of a torsion spring 1280 which is disposed into the common hinge joint, pin or axle 801*c* connecting sides hinged plate 1213 and 1214. Plate 1213 and 1214 are connected in rotary engagement on a common side at pin or axle 801*c*. The other side of plate 1214 not connected to plate 1213 is connected the rear side of plate 140 in rotary engagement via another pin or axle 805*a*. The opposite side of plate 1213 is connected to the base 835 in rotary engagement via pins or axle 805*b*. The base 835 is orthogonal to shaft 110 and has about the same width as plate 140. Hence, when the trigger 159 is not engaged hinged plates 1213 and 1214 are urged to unfold away from each other by the torsion spring 1280 associated with their common hinge axle 801*c* and unfold to translate the plate 140 across the tines 130 outward from shaft 110. Plates 1213 and 1214 are also preferably having a ribbed or embossed surface to provide stiffness at a minimum material weight.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims. For example, it should be appreciated that alternative embodiments also include combination of mechanisms shown in one embodiment with those shown in another.

I claim:

1. A tool for animal waste disposal comprising:

a. a shaft having a top and a bottom, b. a handle extending outward away from a connection to the top of said shaft, said handle having a proximal end connected to said shaft and a distal end at the side opposite the proximal end, c. a lateral lifting surface disposed in a first common plane, said first common plane being substantially horizontal to and coupled to the bottom of said shaft, d. a plate disposed perpendicular and immediately above said lateral lifting surface, e. a trigger having a proximal end in rotary engagement with the distal end of said handle, and an opposing and distal end disposed within the shaft, f. a cable having a proximal end coupled within one of said shaft and said handle and a distal end coupled to said plate via an intermediary rotary coupling within the distal end of said trigger such that the activation of said trigger urges said plate to translate over said lifting surface.

2. A tool for animal waste disposal claim 1 wherein said plate is in hinged connection to the bottom of said shaft and the hinge comprises a spring that urges the plate away from the shaft when the trigger is not engaged.

3. The tool for animal waste disposal claim 2 further comprising a pulley disposed proximal to the bottom of said shaft wherein said cable is guided by said pulley.

4. The tool for animal waste disposal claim 2 wherein said spring biases said plate to draw the distal end of said trigger downward and urge said plate away from said shaft.

5. The tool for animal waste disposal claim 2 wherein the hinged connection comprises a pair of folding plates connected at common hinge disposed between said shaft and said plate.

6. The tool for animal waste disposal claim 2 wherein said spring is a torsion spring.

7. The tool for animal waste disposal claim 1 wherein said lateral lifting surface comprises a plurality of spaced apart tines.

8. The tool for animal waste disposal claim 7 wherein the spaced apart tines have circular cross-sections.

9. The tool for animal waste disposal claim 7 wherein the spaced apart tines are parallel to each other.

10. The tool for animal waste disposal claim 1 wherein the intermediary rotary coupling is a pulley.

11. The tool for animal waste disposal claim 1 wherein engagement of said trigger is operative to sweep said plate over said lifting surface while remaining orthogonal to the first common plane.

12. A tool for animal waste disposal comprising:

a. a shaft having a top and a bottom, b. a lateral lifting surface disposed in a first common plane, said first common plane being substantially horizontal to and coupled to the bottom of said shaft, c. a plate disposed perpendicular and immediately above said lateral lifting surface, d. a means for actuating to urge said plate to translate over said lifting surface wherein the means for actuating is a cable that runs through the shaft and further comprises one or more pulleys that guide the cable.

13. The tool for animal waste disposal according to claim 12 wherein the means for actuating further comprises:

a. a handle extending outward away from a connection to the top of said shaft, said handle having a proximal end connected to said shaft and a distal end at the side opposite the proximal end, b. a trigger having a proximal end in rotary engagement with the distal end of said handle, and an opposing and distal end disposed within the shaft, wherein the trigger comprise at least one of a cylindrical surface and a pulley that guides the cable.

14. The tool for animal waste disposal according to claim 12 wherein the cable has a proximal end coupled within one of said shaft and said handle and a distal end coupled to said plate via an intermediary rotary coupling with the distal end of said trigger such that the activation of said trigger urges said plate to translate over said lifting surface.

15. The tool for animal waste disposal claim 12 wherein said lateral lifting surface comprises a plurality of spaced apart tines.

16. The tool for animal waste disposal claim 15 wherein the spaced apart tines have circular cross sections.

17. The tool for animal waste disposal claim 15 wherein the spaced apart tines are parallel to each other.

18. The tool for animal waste disposal claim 12 the means for actuating is operative to sweep said plate over said lifting surface while remaining orthogonal to the first common plane.

19. The tool for animal waste disposal claim 12 further comprising one or more guide rails that are coupled to the bottom of said shaft and extend outward away from said shaft parallel to the first common plane at a side of the lifting surface and engage a sleeve formed in an end of said plate.

20. The tool for animal waste disposal claim 19 the one or more guide rails have an end stop that extends beyond the edge of the sleeve.

* * * * *